United States Patent [19]

Langguth et al.

[11] 4,257,907

[45] Mar. 24, 1981

[54] DISINFECTANT CLEANING COMPOSITIONS

[75] Inventors: Robert P. Langguth, Overland; Kathie J. Tryson, University City, both of Mo.

[73] Assignee: Monsanto Company, St. Louis, Mo.

[21] Appl. No.: 41,267

[22] Filed: May 21, 1979

[51] Int. Cl.[3] ..... C11D 3/48; C11D 1/22

[52] U.S. Cl. ..... 252/106; 252/550; 252/545

[58] Field of Search ..... 252/106, 550, 553, 545; 424/347

[56] References Cited

U.S. PATENT DOCUMENTS

| | | | |
|---|---|---|---|
| 2,110,074 | 3/1938 | Arnold | 428/329 |
| 2,183,037 | 12/1939 | Bayliss et al. | 252/106 |
| 3,063,895 | 11/1962 | Pearson et al. | 424/347 |
| 3,538,217 | 11/1970 | Dewar et al. | 424/173 |
| 3,558,495 | 1/1971 | Mace | 252/90 |
| 3,824,190 | 7/1974 | Winicov et al. | 252/106 |
| 3,933,671 | 1/1976 | Heile | 252/107 |
| 4,111,844 | 9/1978 | Polony et al. | 252/106 |
| 4,124,520 | 11/1978 | Schwalley et al. | 252/106 |
| 4,157,977 | 6/1979 | Dewar et al. | 252/106 |

FOREIGN PATENT DOCUMENTS

| | | | |
|---|---|---|---|
| 743984 | 1/1956 | United Kingdom | 424/347 |
| 786285 | 11/1957 | United Kingdom | 252/106 |
| 858030 | 1/1961 | United Kingdom | 424/347 |
| 1417117 | 12/1975 | United Kingdom | 252/106 |

OTHER PUBLICATIONS

Hackett, W. J., "Germicidal Cleaners and Anti-Bacterial Cleaning," Detergent Age, Jan. 1968, pp. 84, 86, 98.

*Primary Examiner*—P. E. Willis, Jr.

*Attorney, Agent, or Firm*—S. M. Tarter; W. H. Duffey; R. C. Griesbauer

[57] ABSTRACT

Aqueous compositions useful as disinfectant hard-surface and general purpose household cleaners comprise:

(a) from about 0.03 percent to about 20 percent by weight ortho-benzyl-para-chlorophenol;

(b) from about 1.0 to about 2.5 parts by weight, per part by weight of Component (a), of an alkali metal salt of an alkyl naphthalene sulfonic acid or mixtures thereof;

(c) from about 0.03 to about 1.5 parts by weight, per part by weight of Component (a), of a sulfobetaine surfactant;

(d) from about 0.2 to about 0.5 parts by weight, per part by weight of Component (c), of an anionic surfactant which is a $C_{10}$ to $C_{18}$ alkyl sulfate or mixtures thereof;

(e) from about 0.02 to about 0.05 parts by weight, per combined parts by weight of Components (b), (c) and (d), of a detergency boosting acrylic copolymer.

8 Claims, No Drawings

DISINFECTANT CLEANING COMPOSITIONS

BACKGROUND OF THE INVENTION

This invention relates to disinfectant cleaning compositions useful as hard surface and general purpose household cleansers. More particularly, this invention relates to disinfectant cleaning compositions which contain a phenolic germicide.

DESCRIPTION OF THE PRIOR ART

It is well known that phenols and especially chlorinated phenols are effective germicides. Phenolic germicides are commonly employed in commercial disinfectant products which have become an important means of fighting disease-causing organisms. Such disinfectant products are typically employed in hospitals, schools, homes and public and private facilities to eliminate bacteria found on hard surfaces. A well-known commercially available phenolic germicide is ortho-benzyl-para-chlorophenol which is sold by Monsanto Company under the trademark SANTOPHEN® 1 germicide.

In attempting to formulate cleaning compositions containing phenolic germicides, various problems are encountered due to the nature of the phenolic material. For example, the phenolic materials commonly employed have limited solubility in water and therefore it is usually necessary to employ a solubilizing agent with such phenolic compounds. Furthermore, it is known that the activity or stability of phenolic germicides can be adversely affected by the presence of other ingredients such as inorganic salts, organic detergents and organic solubilizers. Thus it can be appreciated that a difficult formulation problem is presented when attempting to formulate cleaning compositions employing phenolic germicides.

A particular class of surface active agents useful as a solubilizer and stabilizer for phenolic bacteriocides is disclosed in U.S. Pat. No. 3,538,217 issued to N. E. Dewar et al on Nov. 3, 1970. The surface active agents disclosed therein are sulfated ethoxylated primary or secondary alcohols. The compositions disclosed therein are aqueous compositions which contain from about 0.05 to about 1.0 part by weight, on an anhydrous basis, of the sulfated ethoxylated surface active agent for each part by weight of the phenolic component, calculated as the free phenol. It is stated therein that such compositions are highly effective aqueous alkaline phenolic antimicrobial compositions, stable to precipitation and/or deactivation of the phenol compounds.

In U.S. Pat. No. 3,824,190 issued to M. W. Winicov et al, there are disclosed detergent disinfectant compositions which employ a mixture of orthophenylphenol and high activity and/or intermediate activity phenols to provide particularly effective disinfectant action. The compositions disclosed therein also contain an anionic detergent. It is further stated that said compositions can be formulated to include other conventionally employed components such as solvents, builders and the like, as is well known to those skilled in the art.

In the formulation of disinfectant cleaning compositions, in addition to the phenolic component and previously-mentioned solubilizer, other ingredients such as surfactants, builders, chelating agents, solvents, perfumes and the like may be included. A combination of such materials is usually necessary to achieve the various properties for the composition which are deemed important for commercial acceptance of the composition. Criteria deemed important for such compositions include cleaning performance, germicidal effectiveness, temperature stability, solution clarity, foaming properties, odor and low skin irritation. It is typical, for example, to include in a disinfectant composition containing a phenolic and a surfactant, a phosphate builder which boosts the cleaning capability of the surfactant. It is understandable, however, that the previously-mentioned formulation difficulties increase as additional ingredients are included in phenolic disinfectant compositions.

Although phosphate builders have been successfully employed in phenolic disinfectant compositions to achieve compositions with desirable cleaning performance and other properties, it has been particularly difficult to achieve comparable compositions which are phosphate-free. Furthermore, non-phosphate containing disinfectant cleaning compositions are of interest, particularly in areas where the use of phosphates in detergent formulations is restricted.

Accordingly, it is an object of this invention to provide novel non-phosphate containing compositions which exhibit effective cleaning performance and other desirable properties for hard surface disinfectant cleaning compositions.

SUMMARY OF THE INVENTION

In accordance with this invention there are provided aqueous compositions comprising (a) from about 0.03 percent to about 20 percent by weight ortho-benzyl-para-chlorophenol;

(b) from about 1.0 to about 2.5 parts by weight, per part by weight of Component (a), of an alkali metal salt of an alkyl napthalene sulfonic acid or mixtures thereof;

(c) from about 0.03 to about 1.5 parts by weight, per part by weight of Component (a), of a sulfobetaine surfactant;

(d) from about 0.2 to about 0.5 parts by weight, per part by weight of Component (c), of an anionic surfactant which is a $C_{10}$ to $C_{18}$ alkyl sulfate or mixtures thereof;

(e) from about 0.02 to about 0.05 parts by weight, per combined parts by weight of Components (b), (c) and (d), of a detergency boosting acrylic copolymer.

DETAILED DESCRIPTION OF THE INVENTION

The compositions of the present invention employ ortho-benzyl-para-chlorophenol as a germicide. The use of this phenolic compound in disinfectant compositions is well known in the art. For example, it is listed as a preferred phenolic compound in the compositions disclosed in the aforementioned U.S. Pat. No. 3,538,217. Ortho-benzyl-para-chlorophenol is commercially available from Monsanto Company under the trademark SANTOPHEN® 1 germicide.

The amount of ortho-benzyl-para-chlorophenol employed in the aqueous compositions of the present invention can vary, depending upon the desired strength of the composition. A concentrated composition which would be diluted considerably for end-use application can contain as much as about 20 percent by weight ortho-benzyl-para-chlorophenol. Even higher levels are possible, but it would be expected that at much higher levels problems would be encountered in solubilizing the essential components of the compositions of this invention. Disinfectant cleaning compositions are often sold in a concentrated form which is diluted, for example, with from about 25 to about 300 parts by weight of water per part by weight of the concentrated composition, for end-use applications. Aqueous compositions of the present invention at end-use strength can contain levels of ortho-benzyl-para-chlorophenol as low as about 0.03 percent by weight. It is desirable to have at least 0.03 percent by weight ortho-benzyl-para-chlorophenol to assure adequate germicidal effectiveness. In preferred compositions of the present invention the ortho-benzyl-para-chlorophenol is present at from about 0.05 percent to about 5 percent by weight.

The compositions of the present invention also contain an alkyl naphthalene sulfonate, or mixtures thereof, designated as Component (b) herein. Various alkyl naphthalene sulfonates which are well known in the art as being useful as surfactants may be employed. Methods for preparing such compounds are also well known to those skilled in the art. Various alkyl naphthalene sulfonates are listed in the 1978 North American Edition of "McCutcheon's Detergents and Emulsifiers", published by the Manufacturing Confectioner Publishing Co.

It is to be understood that the term "alkyl" as it is used in the description of the naphthalene sulfonate and, unless otherwise specified, as it is used elsewhere herein, includes both straight chain and branched radicals, but not cyclic radicals.

Alkyl naphthalene sulfonates which are useful as surfactants typically contain from 1 to about 3 alkyl groups. Generally preferred alkyl groups are the lower alkyls, i.e., alkyl groups containing from 1 to about 4 carbon atoms. It is preferred that the total number of carbon atoms for all of the alkyl groups in the alkyl naphthalene sulfonate be a maximum of about 9, more preferably a maximum of about 6.

The alkyl naphthalene sulfonate is present in the compositions of the present invention as an alkali metal salt. Alkali metals are well known to those skilled in the art to be metals in Group Ia of the Periodic Table of the Elements. The sodium salt is a preferred alkali metal salt. Those skilled in the art would recognize that alkyl naphthalene sulfonic acid may be employed in preparing the compositions of the present invention, which acid would convert to a salt when the desired alkaline pH of the composition is achieved.

The amount of the alkyl naphthalene sulfonate in the compositions of the present invention varies widely from small amounts in end-use strength compositions to much larger amounts in concentrated compositions. In general, the alkyl naphthalene sulfonate will be present at from about 1 to about 2.5 parts by weight, per part by weight of the ortho-benzyl-para-chlorophenol present in the composition. At levels much less than the lower stated level, the amount of alkyl naphthalene sulfonate would not be sufficient to solubilize the ortho-benzyl-para-chlorophenol. At levels much higher than the upper stated level, it was found that cleaning performance of the composition is adversely affected. A preferred range is from about 1.2 to about 2.2 parts by weight per part by weight of ortho-benzyl-para-chlorophenol.

The compositions of the present invention also contain a sulfobetaine surfactant designated as Component (c) herein. The term "sulfobetaine surfactant" as it is used herein means a material selected from the group of compounds represented by the formula:

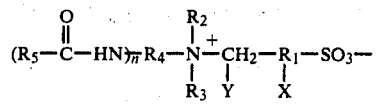

wherein:

$R_1$ is an alkylene radical having from 1 to about 3 carbon atoms,

Y is hydrogen or methyl,

X is hydrogen, methyl or hydroxy, $R_2$ and $R_3$ are each selected from methyl, ethyl and hydroxyethyl radicals, n=0 or 1, when n=0, $R_4$ is an alkyl radical having from about 10 to about 18 carbon atoms, when n=1, $R_4$ is an alkylene radical having from about 2 to about 6 carbon atoms, $R_5$ is an alkyl radical having from about 10 to about 18 carbon atoms;

and mixtures thereof. The presence of the sulfobetaine surfactant results in enhanced cleaning performance an improved foaming properties for the compositions of the present invention.

It is to be understood that the term "alkylene" as it is used herein, encompasses both polymethylene radicals and other divalent saturated aliphatic radicals and thus there may be branching in the linkage provided by the alkylene radical.

The sulfobetaines which are employed in the compositions of the present invention are known in the art and have been described as zwitterionic surfactants. The preparation of such compounds is described, for example, by G. W. Fernley in the JOURNAL OF AMERICAN OIL CHEMISTS SOCIETY, January 1978 (Vol. 55), pages 98–103 and by R. Ernst in U.S. Pat. No. 3,280,179 issued Oct. 18, 1966, which patent is incorporated herein by reference.

In preferred sulfobetaine surfactants, $R_2$ and $R_3$ in the above structure are methyl. It is also preferred that $R_1$ be ethylene.

In one embodiment of the present invention, a sulfobetaine surfactant is employed which has the above structure wherein n equals 0 and $R_4$ is an alkyl radical having from about 10 to about 18 carbon atoms, preferably a straight chain alkyl radical. For these sulfobetaine surfactants, a convenient source of the $R_4$ component is tallow fatty alcohol which consists of a mixture of various chain lengths, with a typical composition being approximately 66 percent $C_{18}$, 30 percent $C_{16}$ and 4 percent $C_{14}$ and others. Another convenient source is the middle cut of distilled coconut fatty alcohol, which also consists of a mixture of various chain lengths, with a typical composition being approximately 66 percent $C_{12}$, 23 percent $C_{14}$, 9 percent $C_{16}$ and 2 percent $C_{10}$.

Specific sulfobetaine surfactants of the above structure wherein n equals 0 are set forth in U.S. Pat. No. 3,539,521 issued on Nov. 10, 1970 to A. O. Snoddy et al, which patent is herein incorporated by reference.

In another embodiment of the present invention, a sulfobetaine surfactant is employed which has the above structure wherein n equals 1 and $R_4$ is an alkylene radical having from about 2 to about 6 carbon atoms, preferably from about 2 to about 4 carbon atoms. In these sulfobetaines wherein n equals 1, $R_5$ is an alkyl radical having from about 10 to about 18 carbon atoms. It is preferred that $R_5$ be straight chain. As previously discussed, convenient sources of alkyl radicals having from about 10 to about 18 carbon atoms are tallow fatty alcohol and coconut fatty alcohol.

Specific sulfobetaine surfactants of the above structure wherein n equals 1 are set forth in the previously-mentioned U.S. Pat. No. 3,280,179.

Particularly preferred for use as the sulfobetaine surfactant in compositions of the present invention are 3-(N,N-dimethyl-N-acylamidopropylammonio)-2-hydroxypropane-1-sulfonates wherein the acyl group is derived from tallow fatty alcohol or coconut fatty alcohol, with coconut fatty alcohol preferred. It would be recognized by those skilled in the art that in the normal preparation of these derivatives of tallow or coconut fatty alcohols, a mixture of sulfobetaines with varying carbon chain lengths for the acyl groups would result. As previously discussed, these fatty alcohols contain for the most part carbon chain lengths which will provide acyl groups with the desired number of carbon atoms, that is from about 11 to about 19 carbon atoms. Thus, these mixtures obtained from tallow or coconut fatty alcohols are useful in providing the sulfobetaine surfactant in the compositions of the present invention. A material of this type particularly preferred for use in the composition of the present invention is N-cocamidopropyl-N,N-dimethyl-N-2-hydroxypropyl sulfobetaine, an example of which is Lonzaine CS, commercially available from Lonza, Inc., Fair Lawn, N.J.

The amount of the sulfobetaine surfactant in the compositions of the present invention is generally from about 0.03 to about 1.5 parts by weight per part by weight of the ortho-benzyl-para-chlorophenol in the composition. It is to be understood that the sulfobetaine surfactant may actually be a mixture of previously described sulfobetaine compounds. It is desirable to employ at least the lower stated level of the sulfobetaine surfactant to achieve desired cleaning performance and foaming properties for the composition. Although higher levels than the above-stated 1.5 parts by weight can be employed, the additional improvements in cleaning and foaming properties resulting from such higher levels would in general not be sufficient to justify the cost of such higher levels. Preferred amounts of the sulfobetaine surfactant are from about 0.1 to about 1.5 parts by weight per part by weight of the ortho-benzyl-para-chlorophenol.

The presence of aforedescribed sulfobetaine surfactants in compositions containing just-described Components (a) and (b) and hereinafter defined Component (e) was found to result in unclear aqueous mixtures at certain end-use dilutions for such compositions. At end-use dilutions which typically contain from about 0.03 percent to about 0.1 percent ortho-benzyl-para-chlorophenol, such compositions were found to be cloudy or milky in appearance. It is believed that the clarity may be dependent on the pH of the diluted composition which is typically 9 to 10, preferably 9.5–10.0, at end-use dilution, which is somewhat lower than the typical pH of concentrated compositions. Although a higher pH may result in a clearer solution, it is desirable to maintain a pH of 9–10, preferably 9.5–10.0, at end-use dilutions to avoid skin irritation and loss of germicidal effectiveness.

Although unclear solutions can be effective disinfectant hard surface cleaners, it is preferable that the solution be clear at end-use dilution. An unclear solution may indicate that an active ingredient is coming out of solution and this may lessen the effectiveness of the composition. Furthermore, a clear solution at end-use dilution is desirable for consumer acceptance of the disinfectant cleaning composition.

Surprisingly, it has been discovered that the inclusion of an anionic surfactant which is a $C_{10}$ to $C_{18}$ alkyl sulfate or mixtures thereof, designated Component (d) herein, in the compositions of the present invention substantially improves the just-described clarity problem which results from employing the sulfobetaine surfactant. Preferred are alkali metal sulfates with sodium and potassium being most preferred. Although not required, it is preferred that the sulfate moiety be attached to a primary carbon atom. Particularly preferred alkyl sulfates are those in which the alkyl group is straight chain. One or more of the alkyl sulfates can be employed.

Exemplary sulfates useful in the present invention are those prepared by sulfating alcohols produced by reducing the glycerides of tallow or coconut oil or sulfating synthetic $C_{10}$–$C_{18}$ straight chain alcohols or mixtures containing such alcohols. It is recognized that sulfating alcohol mixtures may result in mixtures which include, in addition to the desired $C_{10}$–$C_{18}$ alkyl sulfates, other sulfates. Such mixtures may nevertheless be employed as the source of the desired sulfate.

Various alkyl sulfates useful in the compositions of the present invention are found in the aforementioned edition of "McCutcheon's Detergents and Emulsifiers". Examples of useful alkyl sulfates are the sodium sulfate derivative of 7-ethyl-2-methyl, 4-undecanol which is sold by Union Carbide Corporation under the trademark Tergitol 4; sodium cetyl sulfate which is sold by Continental Chemical Company under the trademark Conoco Sulfate C; and sodium lauryl sulfate which is also commercially available.

Sodium lauryl sulfate is particularly preferred for use in the compositions of the present invention.

Surprisingly, a small amount of the alkyl sulfate in the compositions of the present invention results in a clarity improvement. Typically the alkyl sulfate is present at from about 0.2 to about 0.5 parts by weight, per part by weight of the betaine surfactant [Component (c)]. At these levels a substantial improvement in the clarity of the compositions at end-use dilutions is effected. Essentially clear solutions may be achieved. When the alkyl sulfate is employed at much less than the above-stated lower level a desired degree of improvement in the solution clarity at end-use dilutions is not achieved. With respect to the upper level, no significant additional clarity improvement is achieved by using higher amounts and cleaning performance may be adversely affected at much higher amounts. Preferred amounts of the alkyl sulfate are from about 0.3 to about 0.5 parts by weight, per part by weight of the betaine surfactant.

The compositions of the present invention additionally contain a detergency boosting acrylic copolymer designated Component (e) herein. The term "detergency boosting" as it is used in the specification and claims means that the acrylic copolymer enhances the cleaning performance of a composition containing the just-described Components (a), (b), (c) and (d) when added thereto. A typical test for evaluating cleaning performance of compositions of this type is described in Example II hereinafter. Surprisingly, acrylic copolymers which were employed were found to provide enhanced detergency when added at very low levels to compositions containing the aforedescribed materials representing Components (a), (b), (c) and (d) of the compositions of the present invention.

Various acrylic copolymers or mixtures thereof may be employed so long as they boost the detergency of the composition without significantly adversely affecting other desired properties of a disinfectant cleaning composition. In general, the acrylic copolymers which can be employed in the compositions of the present invention can be described as copolymers containing 25 to 70 percent by weight of methacrylic acid units and at least 10 percent by weight of units representing an acrylic acid ester of a lower alcohol having from 1 to 4 carbon atoms. The lower acrylate or a mixture thereof may make up the entire balance of the copolymer (i.e., other than methacrylic acid) or a portion of the balance (up to 40 percent by weight of the copolymer) can be derived from one or more neutral monoethylenically unsaturated copolymerizable monomers, methylmethacrylate being preferred. These copolymers and the preparation thereof are described in British Pat. No. 870,994 published June 21, 1961 and Canadian Pat. No. 623,617 issued July 11, 1961. It is stated in those patents that it is essential that the copolymers contain at least 10 percent by weight of a lower acrylate. The presence of the lower alkyl acrylate imparts stability and serves to make the copolymer insoluble in the free acid form yet soluble in alkaline media. These acrylic copolymers are considered high molecular weight, generally having estimated viscosity average molecular weight substantially in excess of 100,000.

Examples of lower acrylates which can represent units in the copolymers include methyl, ethyl, propyl, isopropyl, n-butyl, sec-butyl, isobutyl and t-butyl acrylates. Ethyl acrylate is preferred as the acrylate unit in these copolymers. Examples of other neutral monoethylenically unsaturated copolymerizable monomers which can represent units in the copolymer are any other acrylate, any ester of methacrylic or itaconic acids, vinyl acetate, vinyl chloride, acrylonitrile, methacrylonitrile, styrene and the like. Methyl methacrylate is a preferred copolymerizable monomer.

In the aforementioned patents, it is stated that the copolymers hereinabove defined can further be modified by introducing small proportions of a polyethylenically unsaturated copolymerizable monomer, such as divinyl benzene or diallyl phthalate. For example, introducing such monomers at from 0.1 to 0.5 percent by weight, based on the total weight of monomers, results in a very low degree of cross-linking which greatly increases the molecular weight of the methacrylic acid copolymers. Such cross-linked copolymers can be employed in the present invention, although noncross-linked types are preferred.

It is to be understood that the acrylic copolymer component in the compositions of the present invention may be a mixture of various copolymer materials.

The acrylic copolymers employed in the present invention can be produced by conventional aqueous emulsion polymerization techniques as described in the aforementioned patents. Aqueous dispersions containing from about 20 to about 50 percent solids by weight can be obtained by the emulsion copolymerization and such dispersions are a convenient form in which the copolymers may be employed. Such dispersions are commercially available from Rohm & Haas Company under the trademarks Acrysol® ASE-60, ASE-75, ASE-95 and ASE-108. The Acrysol® ASE-95 is preferred for use in the present invention.

The amount of acrylic copolymer in the compositions of the present invention is from about 0.02 to about 0.05 parts by weight, per the combined parts by weight of Components (b), (c) and (d). Surprisingly, such low amounts were found to boost the detergency of the compositions of the present invention. The full benefit of enhanced cleaning performance is not realized with amounts much lower than the above-stated lower value. On the other hand, with amounts much higher than the above-stated 0.05 parts by weight, the consistency of the compositions of the present invention changes and the compositions become thickened. When certain levels are reached, the compositions turns into a gel. The compositions of the present invention employ lower amounts such that the composition in general remain liquid, although the thicker gel forms retain most of the properties of the compositions and may be employed to prepare germicidal cleaning compositions by dissolution thereof.

The compositions of the present invention may also contain other ingredients well known in the art and typically employed in disinfectant cleaning compositions. For example, salts of ethylenediaminetetraacetic acid are often included for enhanced germicidal effectiveness of the phenolic germicide. Additionally, dyes, perfumes and color stabilizers are typically present in such compositions.

The compositions of the present invention contain water, the amount of which may vary widely from low amounts in very concentrated compositions to large amounts in end-use strength compositions. The water will be present at from about 5 to about 99 weight percent in concentrated compositions, preferably at least 50 weight percent, and in excess of 99 percent at certain end-use dilutions. Disinfectant cleaning compositions are commonly sold in an aqueous concentrated form which is diluted for end-use.

The compositions of the present invention are alkaline in pH, with a preferred pH of from about 9 to about 12.0. It is desirable that the pH at end-use dilutions be from about 9 to about 10, more preferably about 9.5 to about 10. In general, the compositions at concentrated strengths have a pH higher than the corresponding composition at end-use dilution. An alkali metal hydroxide is typically employed to adjust the pH of the compositions and NaOH is preferred.

The compositions of the present invention are prepared by bringing together the various components in the desired amounts. Those skilled in the art will recognize various means for providing adequate mixtures of the ingredients present in the compositions of the present invention. Although the order of addition of ingredients may vary, it is preferred in preparing the compositions to first mix the acrylic copolymer (usually in the form of an emulsion) with a major portion of the water to be included in the composition. It is desirable to adjust the pH of the mixture of acrylic copolymer and water to about 11 to 13 to facilitate the dissolving of the acrylic copolymer in the water, and to stir until an essentially clear mixture is obtained. To this mixture, the other ingredients of the composition are then added, with the alkyl naphthalene sulfonate [Component (b)] preferably added before the ortho-benzyl-para-chlorophenol.

The following Examples exemplify the present invention in further detail. These Examples are for illustrative purposes only and are not to be construed as limiting the scope of this invention. Unless otherwise stated, all parts, percentages and the like are by weight.

EXAMPLE I

A concentrated disinfectant cleaning composition within the present invention was prepared employing the ingredients listed in Table 1, in the proportions indicated therein.

TABLE 1

| | PARTS BY WEIGHT |
|---|---|
| PRIMARY INGREDIENTS | |
| SANTOPHEN® 1 Solution[1] | 4.3 |
| Petro BA[2] | 10.0 |
| Acrysol® ASE-95[3] | 1.2 |
| Lonzaine CS[4] | 2.0 |
| Solution of Sodium Lauryl Sulfate (30% active) | 1.0 |
| Water | 77.6 |
| OTHER INGREDIENTS | |
| Solution of Tetrasodium salt of Ethylenediaminetetraacetic acid (39% active) | 1.5 |
| Stabilizers | 0.7 |
| Dyes and Perfumes | 0.7 |
| NaOH (for pH adjustments) | 1.0 |
| | 100.0 |

[1]A 72 percent by weight solution of orthobenzyl-para-chlorophenol germicide in isopropanol sold by Monsanto Company.
[2]An aqueous solution containing 50 percent by weight linear alkyl naphthalene sodium sulfonate sold by Petro Chemical Co., Inc.
[3]An acrylic copolymer emulsion (20 percent solids) sold by Rohm & Haas Co.
[4]An aqueous solution containing 50 percent N-cocoamidopropyl-N,N-dimethyl-N-2-hydroxypropyl sulfobetaine sold by Lonza, Inc.

The Acrysol® ASE-95 was first mixed with approximately 90 percent (70 parts) of the water employed and the pH of this mixture was adjusted to 12 with sodium hydroxide. This mixture was stirred until clear and then, in the following order were added the Petro BA, EDTA, stabilizers and SANTOPHEN® 1. Sodium sulfite was employed as a stabilizer. The mixture was continuously stirred during the addition of the materials. The pH of the mixture was then adjusted to 11.5 using sodium hydroxide and then the surfactant(s) (Lonzaine CS and sodium lauryl sulfate), dyes and perfumes were added and the mixture stirred well.

The resulting composition was essentially clear. The pH of the composition was 11.5. At end-use dilution (1 part composition to 64 parts water) the solution was clear and had a pH 9.8.

Various properties desirable for disinfectant compositions are demonstrated for the thus prepared composition in the following Example II.

EXAMPLE II (A) Cleaning Performance

The cleaning performance of the composition of Example I was evaluated employing a modified version of the method for evaluating hard surface cleaners described by R. L. Liss and T. B. Hilton in SOAP AND CHEMICAL SPECIALTIES, August, 1960. In accordance with that procedure, a soil mixture containing oils, solvents and iron oxide (metallic brown) was prepared. A 4 gram sample of this soil mixture was then applied to a strip of white vinyl wallpaper (5.1×30.5 centimeters) and spread to a thickness of about 0.005 centimeters using a "doctor" blade. The soiled wallpaper was then placed in a constant temperature and humidity room (22° C., 50 percent relative humidity) and left overnight to dry.

The wallpaper was then washed in accordance with the aforementioned published procedure except that the cleaning solution employed consisted of 1 part of the composition of Example I diluted with 64 parts of water. Standards were also run which consisted of carrying out the identical washing procedure under the same conditions, substituting commercial hard-surface cleaning compositions for the composition of Example I. Multiple runs (4) were made.

In accordance with the published procedure, cleaning efficiency was determined employing reflectance measurements made with a Gardner Color Difference Meter (Gardner Laboratory, Inc.). The percent cleaning efficiency (percent C.E.) is calculated according to the formula:

$$\% \ C.E. = (R_2/R_1) \times 100$$

wherein $R_1$ equals the reflectance of unsoiled, unwashed wallpaper and $R_2$ equals the reflectance of soiled, washed wallpaper. The percent comparative cleaning efficiency is then calculated as follows:

$$(\% \text{ C.E. Test Sample}/\% \text{ C.E. Standard}) \times 100$$

The results of the cleaning performance evaluation by the just-described procedure are shown in Table 2. The materials employed as standards were commercial hard-surface cleaning compositions, with Standard A containing phosphates and Standard B being phosphate-free.

TABLE 2

| | Comparative Cleaning Efficiency For Composition of Example I | |
|---|---|---|
| | Standard A | Standard B |
| Run 1 | 80% | 231% |
| Run 2 | 72% | 160% |
| Run 3 | 81% | 178% |
| Run 4 | 79% | 129% |

(B) Storage Stability

The storage stability of the composition of Example I under various temperature conditions was determined. Samples of the composition were stored at various temperatures for certain time periods after which a visual check for clarity and change in appearance of the samples was made. In addition, a "freeze/thaw" test was run on the composition. This test consisted of one or more cycles of freezing and thawing of a sample with a visual check for clarity and change in appearance of the sample after each cycle.

The "freeze'thaw" test was run in duplicate, with one run including an inversion of the sample between cycles.

In the stability tests it is desirable that there be no substantial phase separation or precipitation of ingredients in the solution. A solution which remains clear is considered to exhibit outstanding stability.

The results of the storage stability testing are presented in Table 3.

TABLE 3

| | Storage Stability For Composition of Example I |
|---|---|
| STORAGE CONDITION | RESULT |
| Room Temperature (24° C.) | |
| - Overnight | clear - no change |
| - 4 Weeks | clear - no change |
| Refrigerator (3° C.) | |
| - Overnight | clear - no change |

TABLE 3-continued

| Storage Stability For Composition of Example I | |
|---|---|
| STORAGE CONDITION | RESULT |
| - 4 Weeks Oven (43° C.) | clear - no change |
| - Overnight | clear - no change |
| - 4 Weeks | clear - no change |
| Freeze/Thaw Test | |
| 1 cycle - no inversion | white cloudy layer on top 5%, disappears on inversion |
| 4 cycles - no inversion | white cloudy layer on top, not fully dispersed after 5 days |
| 4 cycles - inversion between cycles | white cloudy layer on top 20%, disappears on inversion |

fobetaine and an acrylic copolymer were prepared in accordance with the procedure described in Example I. In certain of the compositions there was included sodium lauryl sulfate, representing hereinbefore defined Component (d) of the compositions of the present invention. In other of the compositions an anionic surfactant not within the definition of Component (d) was included in the compositions. The various compositions prepared are presented in Table 4. The description of ingredients contained in Table 1 hereinbefore applies to the like ingredients in Table 4.

The compositions of Table 4 were tested for clarity at end-use dilutions. The dilution for this clarity testing consisted of adding one part of the composition being tested to 64 parts of tap water (approximately 110 ppm $CaCO_3$ hardness) and stirring well for about 1 minute. The solution was then allowed to stand for about 1 minute and a visual check for clarity was made. The results of the clarity testing are shown in Table 5.

TABLE 4

| | PARTS BY WEIGHT | | | | | | |
|---|---|---|---|---|---|---|---|
| | COMP. B | Comp. C | Comp. D | Comp. E | Comp. F | Comp. G | Comp. H |
| PRIMARY INGREDIENTS | | | | | | | |
| SANTOPHEN® 1 Solution | 4.3 | 4.3 | 4.3 | 4.3 | 4.3 | 4.3 | 4.3 |
| Petro BA | 10.0 | 10.0 | 10.0 | 10.0 | 10.0 | 10.0 | 10.0 |
| Acrysol® ASE-95 | 1.2 | 1.2 | 1.2 | 1.2 | 1.2 | 1.2 | 1.2 |
| Lonzaine CS | 2.0 | 2.0 | 1.0 | 2.0 | 2.0 | 2.0 | 2.0 |
| Solution of Sodium Lauryl Sulfate (30% Active) | | 3.3 | 1.6 | | | | 1.6 |
| Water | 78.8 | 75.5 | 78.2 | 77.1 | 76.8 | 76.3 | 74.7 |
| Other anionic surfactant | | | | 1.7[1] | 2.0[2] | 2.5[3] | 2.5[3] |
| OTHER INGREDIENTS | | | | | | | |
| Solution of Tetrasodium Salt of ethylenediaminetetraacetic acid (39% Active) | 1.5 | 1.5 | 1.5 | 1.5 | 1.5 | 1.5 | 1.5 |
| Stabilizers | 0.7 | 0.7 | 0.7 | 0.7 | 0.7 | 0.7 | 0.7 |
| Dyes and Perfumes | 0.7 | 0.7 | 0.7 | 0.7 | 0.7 | 0.7 | 0.7 |
| NaOH (For pH adjustment to final composition pH 11.5–11.6) | 0.8 | 0.8 | 0.8 | 0.8 | 0.8 | 0.8 | 0.8 |
| | 100.0 | 100.0 | 100.0 | 100.0 | 100.0 | 100.0 | 100.0 |

[1]A solution of a $C_{12}$–$C_{15}$ linear primary alcohol ethoxysulfate sodium salt (58% active).
[2]A solution of a sodium alkyl ($C_{11}$ average) benzene sulfonate (50% Active).
[3]A solution of an alpha olefin sulfonate (40% Active).

(C) Germicidal Effectiveness

The germicidal effectiveness of the composition of Example I against the organisms *Staphylococcus aureus* and *Salmonella choleraesuis* was determined according to the method described in "Official Methods of Analysis of the Association of Official Analytical Chemists" (AOAC), 12th Edition (1975), paragraph 4.007–0.011, pages 59–60. The evaluation was performed on a use dilution of 1 part of the composition of Example I diluted with 64 parts of water. The culture medium was letheen broth. Exposure was for 10 minutes and incubation was for 48 hours at 37° C. For each organism, 60 carriers were exposed.

The results of the germicidal testing for the composition of Example I showed 0 growth in the 60 carriers in the case of the *Salmonella choleraesuis* and 1 growth in the 60 carriers for the case of *Staphylococcus aureus*.

The above Examples I and II clearly demonstrate an effective disinfectant cleaning composition within the present invention.

The following Example III demonstrates the improvement in clarity at end-use dilutions which is achieved with compositions within the present invention. In Example III compositions within the present invention are Compositions C, D and H.

EXAMPLE III

Various compositions containing ortho-benzyl-parachlorophenol, an alkyl naphthalene sulfonate, a sul-

TABLE 5

| CLARITY AT END-USE DILUTION | | |
|---|---|---|
| Composition | pH of Dilute Solution | Visual Clarity |
| B | 9.9 | Quite Cloudy |
| C | 9.9 | Clear |
| D | 9.7 | Clear |
| E | 10.0 | Cloudy |
| F | 10.0 | Fairly Cloudy |
| G | 10.0 | Fairly Cloudy |
| H | 10.0 | Slightly Cloudy |

The results in Table 5 demonstrate clarity improvement achieved by inclusion of an alkyl sulfate in compositions of the present invention. Compositions C and D, which contain sodium lauryl sulfate, were clear at end-use dilution, whereas Composition B, which contains the same ingredients except for additional water being substituted for the sodium lauryl sulfate, was quite cloudy. Compositions E, F and G which contain the same ingredients as Composition B and in addition an anionic surfactant which is not a $C_{10}$–$C_{18}$ alkyl sulfate did not show such a clarity improvement over Composition B. Composition H which contains sodium lauryl sulfate shows an improvement over Composition G.

Although the invention has been described in terms of specific embodiments which are set forth in considerable detail, it should be understood that such is for illustration purposes and the invention is not necessarily limited thereto. Alternative embodiments will become apparent to those skilled in the art in view of the disclosure herein. For example, those skilled in the art will recognize many uses as a general purpose cleaner for the compositions of the present invention which are not specifically mentioned herein. Those skilled in the art will also recognize various additional components which may be incorporated in the compositions of the present invention and various means for employing such compositions. Accordingly, such embodiments would not be a departure from the spirit of the present invention.

What is claimed is:

1. An aqueous composition comprising:

(a) from about 0.03 percent to about 20 percent by weight ortho-benzyl-para-chlorophenol;

(b) from about 1.0 to about 2.5 parts by weight, per part by weight of Component (a), of an alkali metal salt of an alkyl naphthalene sulfonic acid, or mixtures thereof;

(c) from about 0.03 to about 1.5 parts by weight, per part by weight of Component (a), of a sulfobetaine surfactant;

(d) from about 0.2 to about 0.5 parts by weight, per part by weight of Component (c), of an anionic surfactant which is a $C_{10}$–$C_{18}$ alkyl sulfate or mixtures thereof:

(e) from about 0.02 to about 0.05 parts by weight, per combined parts by weight of Components (b), (c) and (d), of a detergency boosting acrylic copolymer.

2. A composition in accordance with claim 1 wherein the alkyl naphthalene sulfonic acid of Component (b) contains from 1 to about 3 alkyl groups with the total number of carbon atoms for said groups being a maximum of about 9.

3. A composition in accordance with claim 1 wherein Component (c) comprises a 3-(N,N-dimethyl-N-acylamidopropylammonio)-2-hydroxypropane-1-sulfonate wherein the acyl group is derived from tallow fatty alcohol or coconut fatty alcohol.

4. A composition in accordance with claim 3 wherein the acyl group is derived from coconut fatty alcohol.

5. A composition in accordance with claim 1 wherein Component (d) comprises a sodium or potassium straight-chain alkyl sulfate.

6. A composition in accordance with claim 5 wherein Component (d) comprises sodium lauryl sulfate.

7. A composition in accordance with claim 1, 2, 3, 4, 5 or 6 wherein Component (a) is present at from about 0.05 percent to about 5 percent by weight.

8. An aqueous composition comprising:

(a) from about 0.05 percent to about 5 percent by weight ortho-benzyl-para-chlorophenol;

(b) from about 1.0 to about 2.5 parts by weight, per part by weight of Component (a), of an alkali metal salt of an alkyl naphthalene sulfonic acid which contains from 1 to about 3 alkyl groups with the total carbon atoms for said alkyl groups being a maximum of about 9, or mixtures thereof;

(c) from about 0.03 to about 1.5 parts by weight, per part by weight of Component (a), of at least one 3-(N,N-dimethyl-N-acylamidopropylammonio)-2-hydroxypropane-1-sulfonate wherein the acyl group has from about 11 to about 19 carbon atoms and is derived from coconut fatty alcohol;

(d) from about 0.2 to about 0.5 parts by weight, per part by weight of Component (c), of sodium lauryl sulfate;

(e) from about 0.02 to about 0.05 parts by weight, per combined parts by weight of Components (b), (c) and (d), of a detergency boosting acrylic copolymer.

* * * * *